US010441002B2

(12) United States Patent
Ironi

(10) Patent No.: US 10,441,002 B2
(45) Date of Patent: Oct. 15, 2019

(54) APPARATUS FOR NURSING AND/OR HANDS-FREE PUMPING WITH ADJUSTABLE CROSSOVER COVER PANELS

(71) Applicant: Emily Ironi, Venice, CA (US)

(72) Inventor: Emily Ironi, Venice, CA (US)

(73) Assignee: The Dairy Fairy, Inc., Belmont, CA (US)

( * ) Notice: Subject to any disclaimer, the term of this patent is extended or adjusted under 35 U.S.C. 154(b) by 716 days.

(21) Appl. No.: 13/831,876

(22) Filed: Mar. 15, 2013

(65) Prior Publication Data

US 2014/0087625 A1 Mar. 27, 2014

Related U.S. Application Data

(60) Provisional application No. 61/706,319, filed on Sep. 27, 2012, provisional application No. 61/711,107, filed on Oct. 8, 2012.

(51) Int. Cl.
*A41C 3/04* (2006.01)
*A41C 3/00* (2006.01)

(52) U.S. Cl.
CPC ..... *A41C 3/04* (2013.01); *A41C 3/0028* (2013.01); *A41C 3/0092* (2013.01)

(58) Field of Classification Search
CPC ..... A41C 3/04; A41C 3/0028; A41C 3/0071; A41C 3/02; A41C 3/00
USPC ..... 450/36, 50, 68, 71, 74, 79, 62, 63, 58, 450/77, 86; 604/74
See application file for complete search history.

(56) References Cited

U.S. PATENT DOCUMENTS 2,679,048 A * 5/1954 Alberts ..... 450/36
3,378,013 A * 4/1968 Bruno ..... A41C 3/00 450/58
5,180,326 A * 1/1993 Williams ..... A41C 3/148 2/73
5,378,192 A * 1/1995 Darmante ..... A41C 3/0028 2/106
5,749,768 A 5/1998 Green
6,068,538 A * 5/2000 Alleyne ..... A41C 3/02 450/1
6,227,936 B1 5/2001 Mendoza
(Continued)

FOREIGN PATENT DOCUMENTS

CA 2688737 A1 6/2010
WO 2008113867 A1 9/2008

*Primary Examiner* — Timothy K Trieu
(74) *Attorney, Agent, or Firm* — David D. Griner; Randall W. Burton

(57) ABSTRACT

Provided herein is an apparatus to be worn by a lactating individual or nursing woman or mother for breastfeeding and/or hands-free pumping. The apparatus comprises an outermost crossover cover panel attached via a panel connector to a bottom elastic band of the apparatus; whereby disconnecting the crossover cover panel at the panel connector exposes the multiple underlying pumping panels for hands-free pumping. In another embodiment, disconnecting the crossover cover panel at the panel connector exposes a nursing panel. Advantageously, the apparatus disclosed herein is designed with the adjustable outermost crossover cover panels for accommodating fluctuations in breast size and as a convenient and functional reminder to alternate breasts when pumping and/or nursing.

19 Claims, 7 Drawing Sheets

(56) References Cited

U.S. PATENT DOCUMENTS

| | | | | |
|---|---|---|---|---|
| 6,974,361 | B2 | 12/2005 | Cravaak | |
| 6,983,489 | B2 | 1/2006 | Caprio | |
| 7,056,186 | B1 | 6/2006 | Weyenberg et al. | |
| 7,448,090 | B2 | 11/2008 | Lucock | |
| 7,448,937 | B2 * | 11/2008 | Weyenberg et al. | 450/63 |
| D597,278 | S | 8/2009 | Cavosie | |
| 8,123,587 | B2 | 2/2012 | Liegey | |
| 8,137,153 | B2 | 3/2012 | Bell | |
| 8,192,247 | B2 | 6/2012 | Abbaszadeh | |
| 8,307,463 | B2 | 11/2012 | Ritchie | |
| 8,323,070 | B2 | 12/2012 | Abbaszadeh | |
| 8,469,770 | B2 | 6/2013 | Alva | |
| 8,651,917 | B2 | 2/2014 | Lopez | |
| 8,668,547 | B2 | 3/2014 | Boonen | |
| 2008/0022434 | A1 * | 1/2008 | Adelman | A41D 1/205 2/104 |
| 2008/0064299 | A1 * | 3/2008 | La Fontaine | A41C 3/04 450/36 |
| 2010/0159802 | A1 | 6/2010 | Abbaszadeh | |
| 2011/0092134 | A1 * | 4/2011 | Alva | A41C 3/04 450/36 |
| 2011/0237156 | A1 | 9/2011 | Boonen | |
| 2011/0314587 | A1 * | 12/2011 | Ritchie | A41C 3/04 2/104 |
| 2012/0021669 | A1 * | 1/2012 | Johnstone | A41C 3/0028 450/58 |
| 2013/0095727 | A1 | 4/2013 | Abbaszadeh | |
| 2013/0122780 | A1 | 5/2013 | McCall | |

* cited by examiner

APPARATUS FOR NURSING AND/OR HANDS-FREE PUMPING WITH ADJUSTABLE CROSSOVER COVER PANELS

RELATED APPLICATIONS

This application claims the benefit of U.S. Provisional Application No. 61/706,319, filed Sep. 27, 2012; and U.S. Provisional Application No. 61/711,107, filed Oct. 8, 2012, each disclosure of which is hereby incorporated herein by reference in its entirety. In addition, all documents and references cited herein and in the above referenced applications, are hereby incorporated herein by reference.

FIELD OF THE INVENTION

The present invention relates to the field of apparatuses and wearable products designed to support a lactating individual, nursing woman or mother.

BACKGROUND OF THE DISCLOSURE

It is generally well known breast milk provides the best nourishment for a growing baby. It is a natural and beneficial source of nutrition providing the healthiest start for an infant. It also promotes a unique and emotional connection between mother and baby. In fact, the American Academy of Pediatrics (AAP) recommends exclusive breastfeeding for a minimum of six (6) months of a baby's life and breastfeeding in combination with the introduction of complementary foods until at least twelve (12) months of age, and continuation of breastfeeding for as long as mutually desired by mother and baby. (AAP (2012) Pediatrics. 129(3):e827).

It is also well known that breastfeeding comes with many challenges, particularly for working women. It is for this reason The Patient Protection and Affordable Care Act passed by Congress in March 2010 mandates that employers provide "reasonable break time" for nursing mothers and private non-bathroom areas to express breast milk during their workday.

One tool often used to assist with the expression of breast milk, is a mechanical device commonly known as a breast pump. A breast pump is designed to suction the milk from the breasts via a flange attachment connected to a collection container or bottle. A breast pump therefore provides a convenient means through which a woman may extract and store breast milk for later use.

While convenient, the use of a breast pump is still a time-consuming process which can be made more efficient with the advent of wearable products designed to support hands-free pumping. Moreover, many of these products, as well as the apparatus of the present invention, were designed to support nursing while also supporting hands-free pumping at the same time. It is generally well known within breastfeeding circles that nursing and pumping simultaneously will maximize milk production. This is because nursing can enhance the milk let-down reflex, and consequently, and advantageously, increase milk output in the opposite (pumped) breast.

U.S. Pat. Nos. 6,227,936; 8,137,153; 8,323,070; 8,307,463; US 20010092134; and US 20120021669, for example, disclose breast pump/nursing support solutions designed to be worn for hands-free pumping and/or nursing. However, none of these references disclose the embodiments of the present invention.

Therefore, a need exists in the field of hands-free breast pumping and/or nursing, for an apparatus supporting the same, which is designed with adjustable outermost crossover cover panels for accommodating fluctuations in breast size. Additionally, the crossover cover panel design feature is a functional reminder; depending upon which side (right or left) the crossover cover panel is situated outermost or innermost, to alternate breasts when pumping and/or nursing.

SUMMARY OF THE INVENTION

The present inventor has designed an apparatus to be worn by a lactating individual or nursing woman or mother for supporting hands-free pumping and/or nursing while also comfortably and stylishly accommodating fluctuations in breast size as well as conveniently reminding the user to alternate breasts when pumping and/or nursing. For the purposes of the apparatus of the present invention, "hands-free pumping and/or nursing" is intended to cover the act of hands-free pumping in one breast or both breasts; hands-free pumping in one breast while the other breast is being used for nursing; or the use of one breast or both breasts for nursing.

In one aspect, disclosed herein is an apparatus to be worn by a lactating individual for breastfeeding and/or hands-free pumping; the apparatus comprising: a bra panel comprising multiple underlying pumping panels, wherein the bra panel is attached via a detachable connection to an elastic shoulder strap of the apparatus; whereby detaching the bra panel at the detachable connection thereby exposes a breast for breastfeeding; and an outermost crossover cover panel attached via a panel connector to a bottom elastic band of the apparatus; whereby disconnecting the crossover cover panel at the panel connector exposes the multiple underlying pumping panels within the bra panel for hands-free pumping.

In another embodiment of the apparatus, the multiple underlying pumping panels comprise overlapping layers of fabric; whereby pulling apart the overlapping layers of fabric creates an opening over a breast nipple to accommodate a breast pump flange.

In another embodiment of the apparatus, the overlapping layers of fabric are stretchable or elastic.

In another embodiment of the apparatus, the overlapping layers of fabric are at least two overlapping layers of fabric.

In another embodiment of the apparatus, the overlapping layers of fabric are three overlapping layers of fabric.

In another embodiment of the apparatus, the overlapping layers of fabric are two overlapping layers of fabric and a bottom layer of fabric which is a breast sling.

In another embodiment of the apparatus, the detachable connection is a clip or a snap having a male portion and a female portion.

In another embodiment of the apparatus, the panel connector comprises more than one connector slot, stitch, hole, eye, link, or loop for adjustable closure.

In another embodiment of the apparatus, the panel connector comprises at least one of VELCRO®, zippers, snaps, ties, or buttons.

In another embodiment of the apparatus, the panel connector comprises a hook. In yet another embodiment of the apparatus, the hook is a swan hook or an "s" hook.

In another embodiment, the apparatus comprises a pair of bra panels and a pair of outermost crossover panels.

In another embodiment, the apparatus is selected from the group consisting of a bra, camisole, tank top, dress, and shin.

In another aspect of the present invention, herein disclosed is an apparatus to be worn by a lactating individual for breastfeeding and/or hands-free pumping; the apparatus comprising: a pair of bra panels, wherein each bra panel comprises multiple underlying pumping panels, wherein the bra panel is attached via a detachable connection to a permanent elastic shoulder strap of the apparatus; whereby detaching the bra panel at the detachable connection thereby exposes a breast for breastfeeding; and a pair of outermost crossover cover panels, wherein each outermost crossover panel is attached via a panel connector to a bottom elastic band of the apparatus; whereby disconnecting the crossover cover panel at the panel connector exposes the multiple underlying pumping panels within the bra panel for hands-free pumping.

In other embodiments, the apparatus comprising the pair of bra panels and the pair of outermost crossover cover panels in the preceding paragraph may additionally incorporate any of the preceding disclosed embodiments.

In another aspect of the present invention, herein disclosed is an apparatus to be worn by a lactating individual for breastfeeding; the apparatus comprising: a pair of outermost crossover cover panels, wherein each outermost crossover cover panel is attached via a panel connector to a bottom elastic band of the apparatus; whereby disconnecting the crossover cover panel at the panel connector exposes a nursing panel.

In another embodiment, the nursing panel is a fabric layer comprising an opening suitable for breastfeeding mode.

In other embodiments, the apparatus comprising the pair of outermost crossover cover panels in the preceding paragraph may additionally incorporate any of the preceding disclosed embodiments.

The Summary of the Invention is not intended to define the claims nor is it intended to limit the scope of the invention in any manner.

Other features and advantages of the invention will be apparent from the following Drawings, Detailed Description, and the Claims.

BRIEF DESCRIPTION OF THE DRAWINGS

FIG. 4A illustrates a front view of the apparatus showing detachment of a bra panel exposing a breast for breastfeeding mode on one side and disconnection of one outermost crossover cover panel exposing the multiple underlying pumping panels for hands-free pumping mode on the other side. Figure B illustrates a similar front view as FIG. 4A showing each side in breastfeeding mode and hands-free pumping mode. The view of the side in hands-free pumping mode shows a breast pump flange inserted into the multiple pumping panels.

DETAILED DESCRIPTION OF THE EMBODIMENTS

Figure 1:
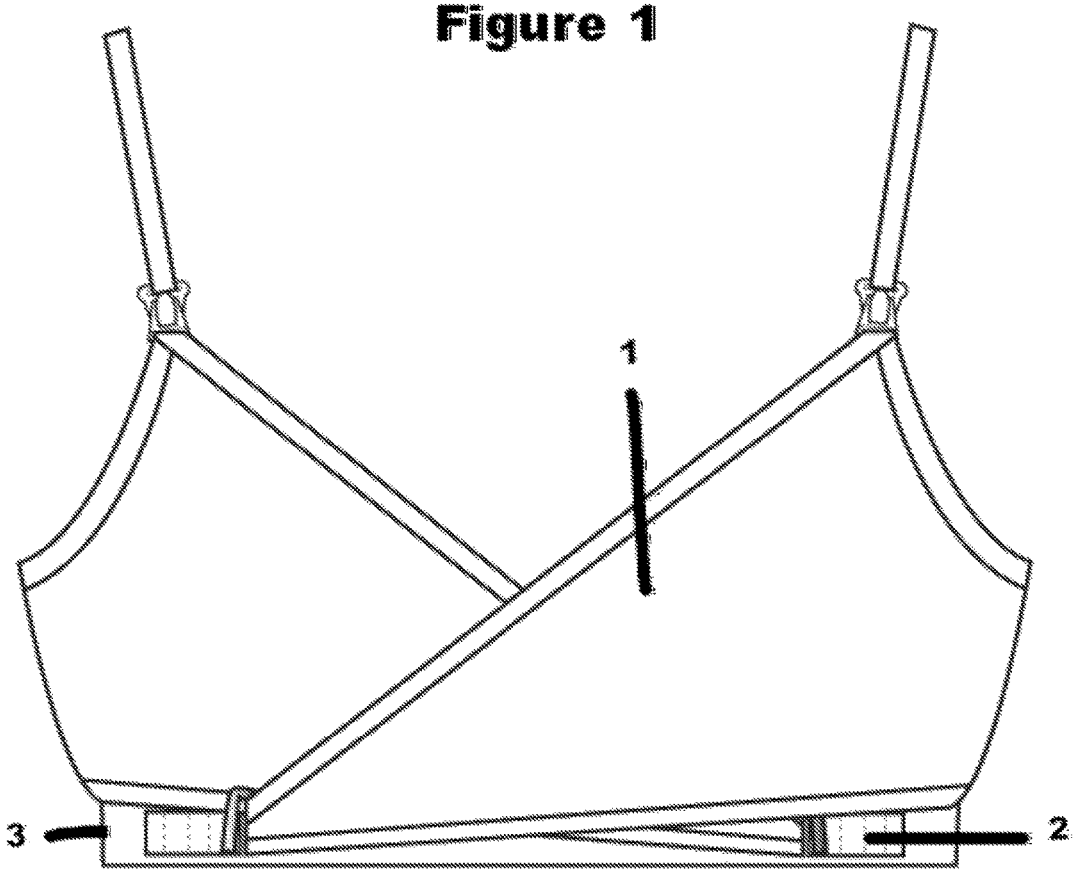
FIG. 1 illustrates a front view of the apparatus showing each bra panel connected via a detachable connection and each outermost crossover cover panel connected via the panel connector providing discreet coverage of the breasts and hands-free pumping panels.

The present invention is illustrated in the drawings and description in which like elements are assigned the same reference numerals. However, while particular embodiments are illustrated in the drawings, there is no intention to limit the present invention to the specific embodiment or embodiments disclosed. Rather, the present invention is intended to cover all modifications, alternative constructions, and equivalents falling within the spirit and scope of the invention. As such, the drawings are intended to be illustrative and not restrictive.

A lactating individual, or nursing woman or mother often experiences fluctuations in breast size. For example, it is common during lactation for a woman to have a dominant breast which can be an entire cup size larger than its counterpart. It is also common for breasts to swell to a larger size as they fill up with milk, and shrink in size after breastfeeding or pumping. This issue presents a challenge in finding a suitable product for convenient nursing and/or efficient hands-free pumping but which is also capable of maintaining a supportive yet comfortable fit for each fluctuating breast. In addition, to maximize breast milk production, many women choose to alternate breasts when breastfeeding and/or pumping, yet it can sometimes be difficult to recall which breast was last used for pumping and/or nursing.

An apparatus of the present invention comprising outermost adjustable crossover cover panels conveniently provides the ability to accommodate breast size fluctuations in each breast. The innovative design of the crossover cover panels additionally provides a functional reminder to alternate breasts when breastfeeding and/or pumping depending upon which side (right or left) the crossover cover panel is situated outermost or innermost.

Exemplary embodiments of the present invention are depicted in FIGS. 1-6.

In FIG. 1, a front view embodiment of an apparatus for nursing and/or hands-free pumping with adjustable crossover cover panels is shown. The outermost crossover cover panels 1 are in a closed position, each stretching across the user's breasts so that one end of a panel connector 2 can be adjoined to the other end of the panel connector 2. In the closed position, both ends of the panel connector 2 are situated on a fabric-covered elastic band 3 which serves as horizontal support for the apparatus and wraps around the torso of the user. The panel connector 2 may comprise any readily available means through which one end of the panel connector 2 may be adjoined securely to the other end of the panel connector 2 so long as the panel connector 2 also functions as a means through which the outermost crossover cover panels 1 may be adjusted accordingly for breast size fluctuation. Such panel connectors 2 are designed to comprise connection mechanisms that are generally available and conventional in the art and may include but are not limited to connector structures such as hooks and corresponding connector slots, stitches, holes, eyelets, links, or loops for adjustable closure. Readily available hooks may be but are not limited to swan hooks and/or "s" hooks. Other panel connector 2 connection mechanisms may include but are not limited to VELCRO®, zippers, snaps, ties, and/or buttons. Optionally, at the middle front upper point of overlap of the outermost crossover panels 1 of the apparatus, the apparatus may be designed with an adjoining mechanism to provide a means through which the overlapping crossover cover panels can be securely connected. For example, a button, snap, clip or hook may be utilized for this purpose.

In another embodiment of an apparatus of the present invention comprising adjustable crossover cover panels, the outermost crossover cover panels comprise a nursing panel comprising an opening suitable for breastfeeding mode. The outermost crossover cover panels in a closed position will each stretch across the user's breasts so that one end of a panel connector can be adjoined to the other end of the panel connector. In the closed position, both ends of the panel connector will be situated on a fabric-covered elastic band which serves as horizontal support for the apparatus and wraps around the torso of the user. In the open position, the outermost crossover cover panels will expose a nursing panel for breastfeeding mode. A nursing panel in this embodiment may be stretchable or elastic material such as but not limited to spandex, LYCRA®, cotton LYCRA®, or nylon LYCRA®. In this embodiment, an apparatus of the invention comprising the crossover cover panels would not require a bra panel with a detachable connection or nursing clip. Rather, in this embodiment, such an apparatus will require less hardware, such as a detachable connection or nursing clips and the like, and will therefore be more suitable as comfortable sleepwear for a lactating individual, woman or mother.

Figure 2:
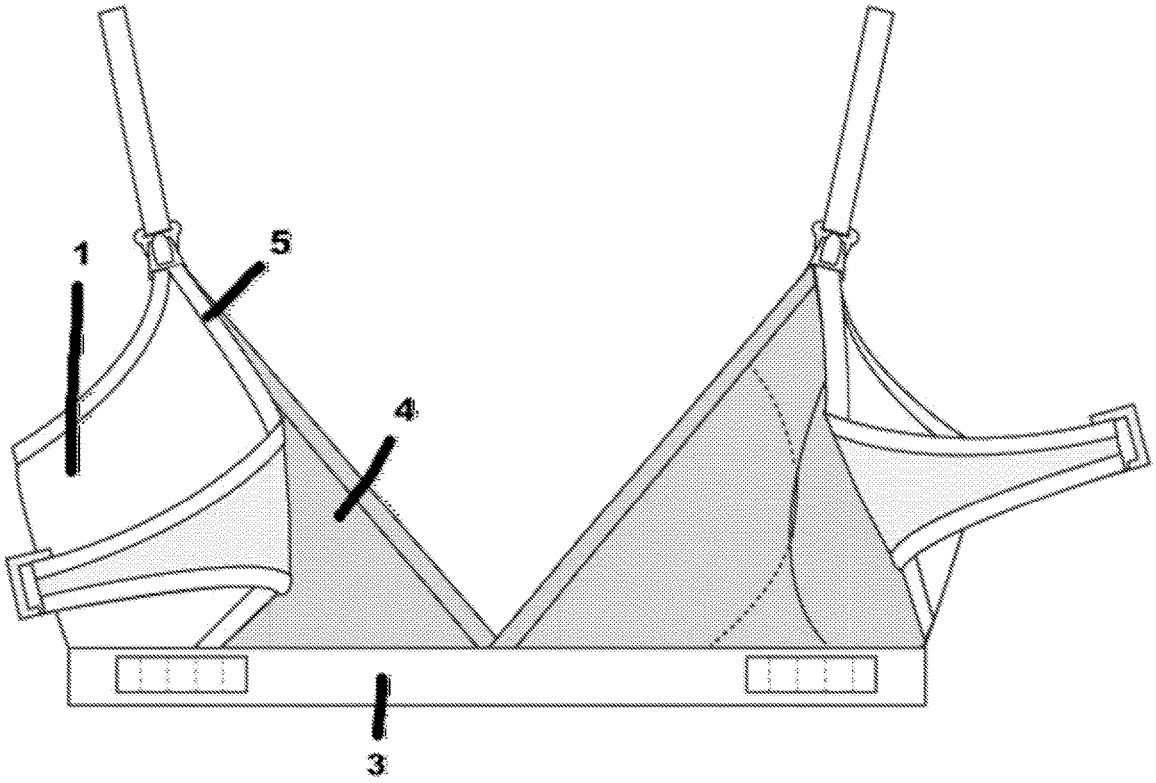
FIG. 2 illustrates a front view of the apparatus showing disconnection of each outermost crossover cover panel exposing the multiple underlying pumping panels providing for a convenient vet efficient hands-free pumping mode.

FIG. 2 is a front view of an embodiment of an apparatus for nursing and/or hands-free pumping with adjustable crossover cover panels 1. The outermost crossover cover panels 1 are in an open position, each exposing the multiple underlying pumping panels 4 comprising overlapping layers of fabric sewn into the bottom elastic band 3 and into the outer binding 5. The embodiment depicted in FIG. 2 shows three overlapping layers of fabric, for example, two side layers, and a center layer. In other embodiments, the overlapping layers of fabric may comprise a top layer, a center layer and a bottom layer. In still another embodiment, there may be two layers of overlapping fabric. The user of the apparatus of the present invention will pull apart the overlapping layers of fabric creating an opening over a breast nipple to accommodate a breast pump flange. In some embodiments, the overlapping layers of fabric include stitching to minimize, narrow, or tighten the opening over a breast nipple. In another embodiment, a bottom layer may also be designed in varying sizes for functioning as a sling for supporting the breast. The overlapping layers of fabric may be made from material including but not limited to spandex, LYCRA®, cotton LYCRA®, or nylon LYCRA®. In the embodiment illustrated in FIG. 2, the apparatus is finished with a binding 5 which hides the sewing seams.

Figure 3:
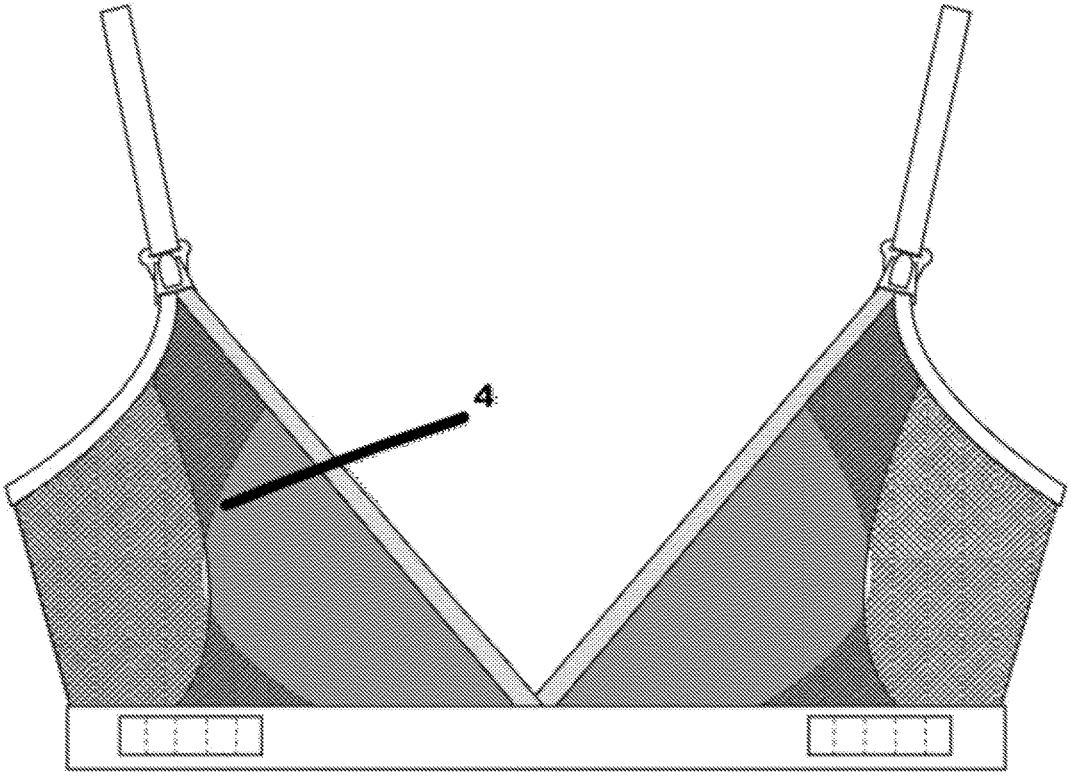
FIG. 3 depicts the overlap detail of three overlapping fabric layers of the multiple underlying pumping panels.

FIG. 3 shows an apparatus of the present invention with a view underlying the outermost crossover cover panels (not shown) and therefore depicting an embodiment of the overlap details of the layers of fabric within the multiple pumping panels 4.

Figure 4A:
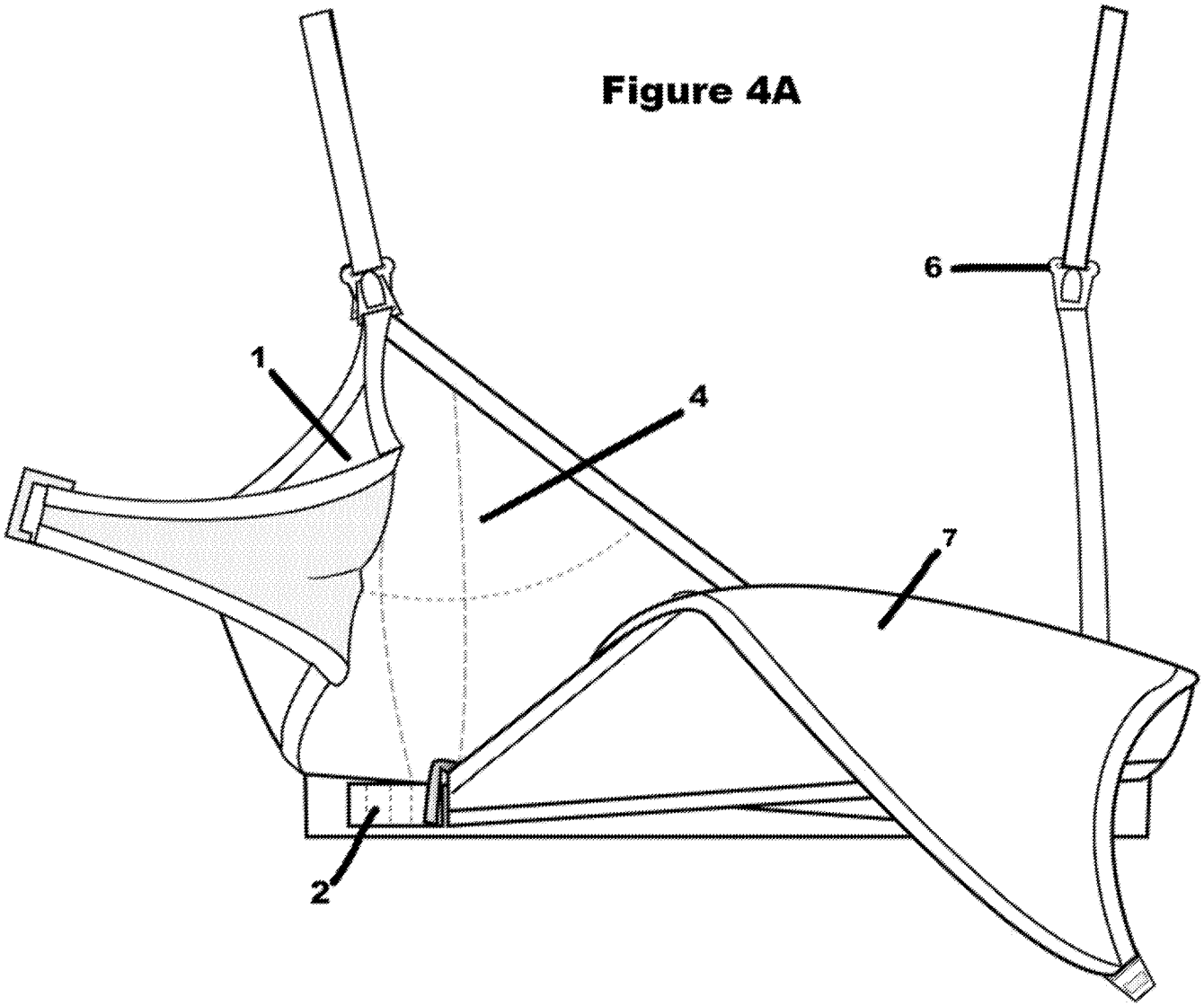
FIGS. 4A and 4B.

FIG. 4A is an embodiment of a front view of an apparatus for nursing and/or hands-free pumping with adjustable crossover cover panels 1 showing one side of the apparatus in nursing mode with the detachable connection 6 detached and the bra panel 7 folded downward thereby exposing the breast. In this embodiment, the other side of the apparatus is shown in hands-free pumping mode with the panel connector 2 disconnected exposing the underlying multiple pumping panels 4.

Figure 4B:
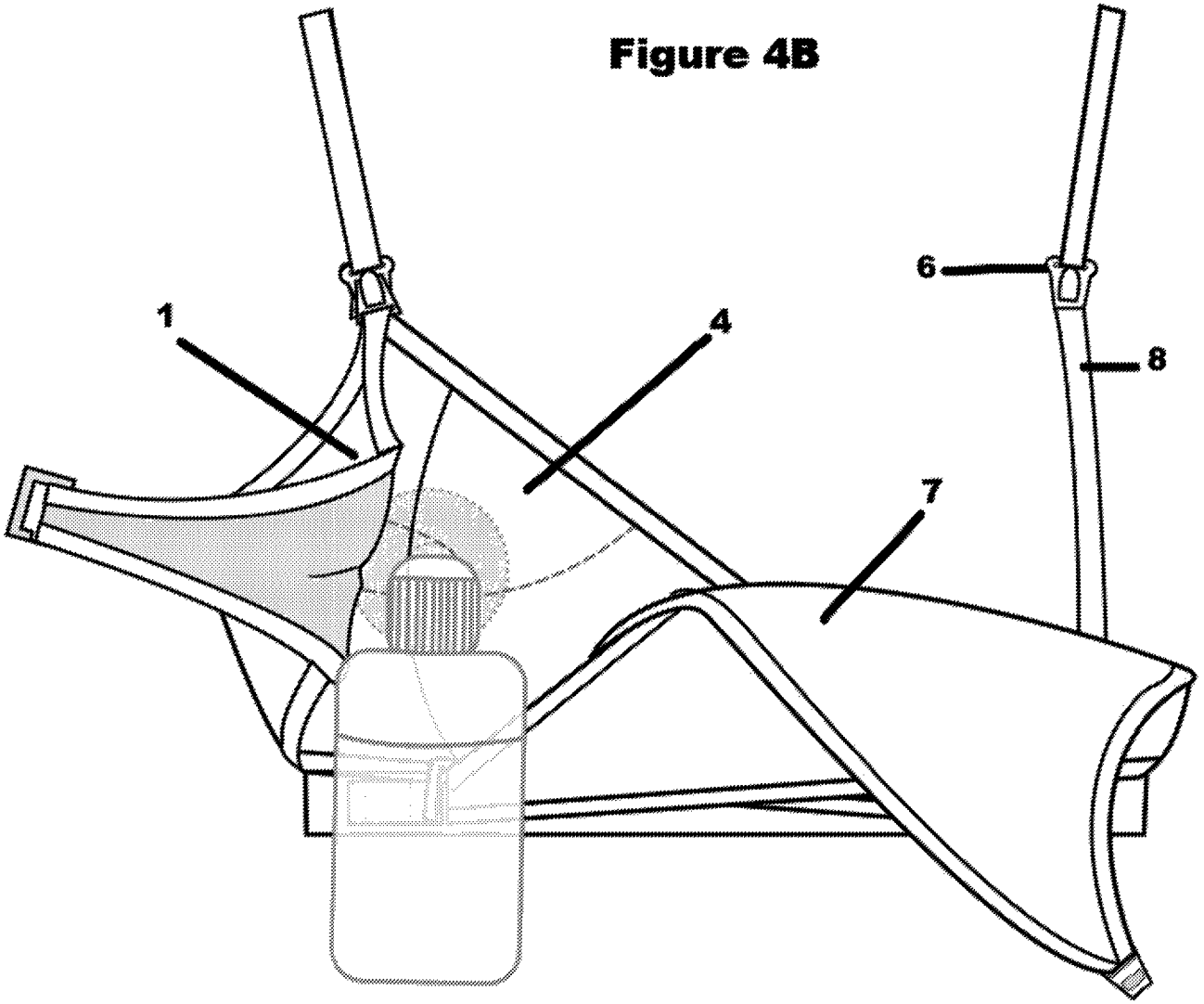

FIG. 4B is an embodiment of a from view of an apparatus for nursing and/or hands-free pumping with adjustable crossover cover panels 1 showing a similar view as shown in FIG. 4A of the apparatus in nursing mode with the detachable connection 6 detached, and the bra panel 7 folded downward thereby exposing the breast. In this embodiment, the opposite side of the apparatus is shown in hands-free pumping mode with the panel connector (not shown) disconnected exposing the underlying multiple pumping panels 4. In this embodiment, a view of a breast pump flange is shown to be inserted into the multiple pumping panels on the side of the apparatus in hands-free pumping mode. Detachable connections 6 or nursing bra clips are generally available and known. In one embodiment, they are located at the top of the bra panel and on the elastic shoulder strap 8. Such detachable connections or nursing bra clips include but are not limited to clips and snaps having a male part and a female part for connectivity, clipping and unclipping, and/or snapping and unsnapping, so that when the bra panel 7 is disconnected, the breast is exposed for nursing/breastfeeding mode.

Figure 5:
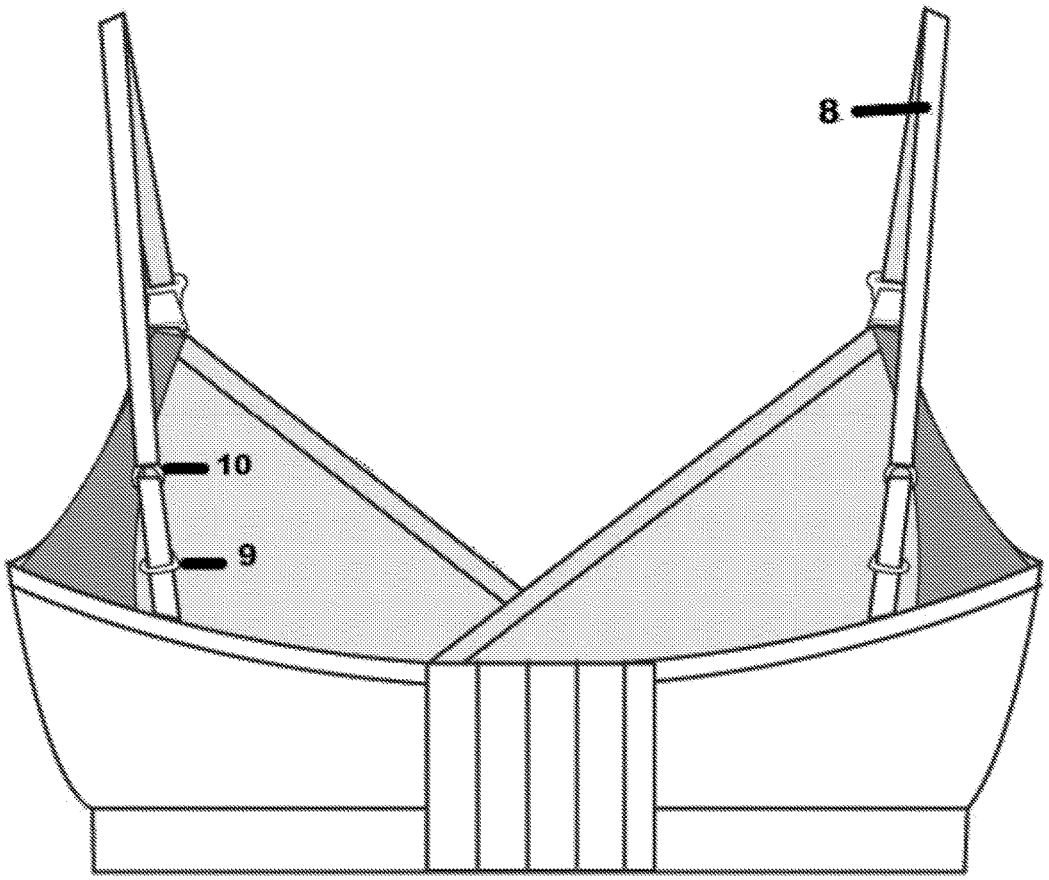
FIG. 5 illustrates a back view of the apparatus.

FIG. 5 shows an embodiment of a back view of an apparatus of the present invention. This embodiment depicts a closed configuration which may be a conventional hook and eye closure with rows of hooks and eyes sewn on a fabric tab to create a tight closure. This embodiment also depicts components of the elastic shoulder strap 8 with an adjuster 9 and an O-ring 10. In another embodiment, the elastic shoulder straps 8 can be crisscrossed in the back for a racer back effect. In still another embodiment, the elastic strap 8 components may include an adjuster and/or a swan hook and a sewn loop for accommodating the swan hook. In yet another embodiment, the back of the apparatus may not have a closure mechanism and rather may have a solid back panel of stretchable or elastic material including but not limited to spandex, LYCRA®, cotton LYCRA®, or nylon LYCRA®.

Figure 6:
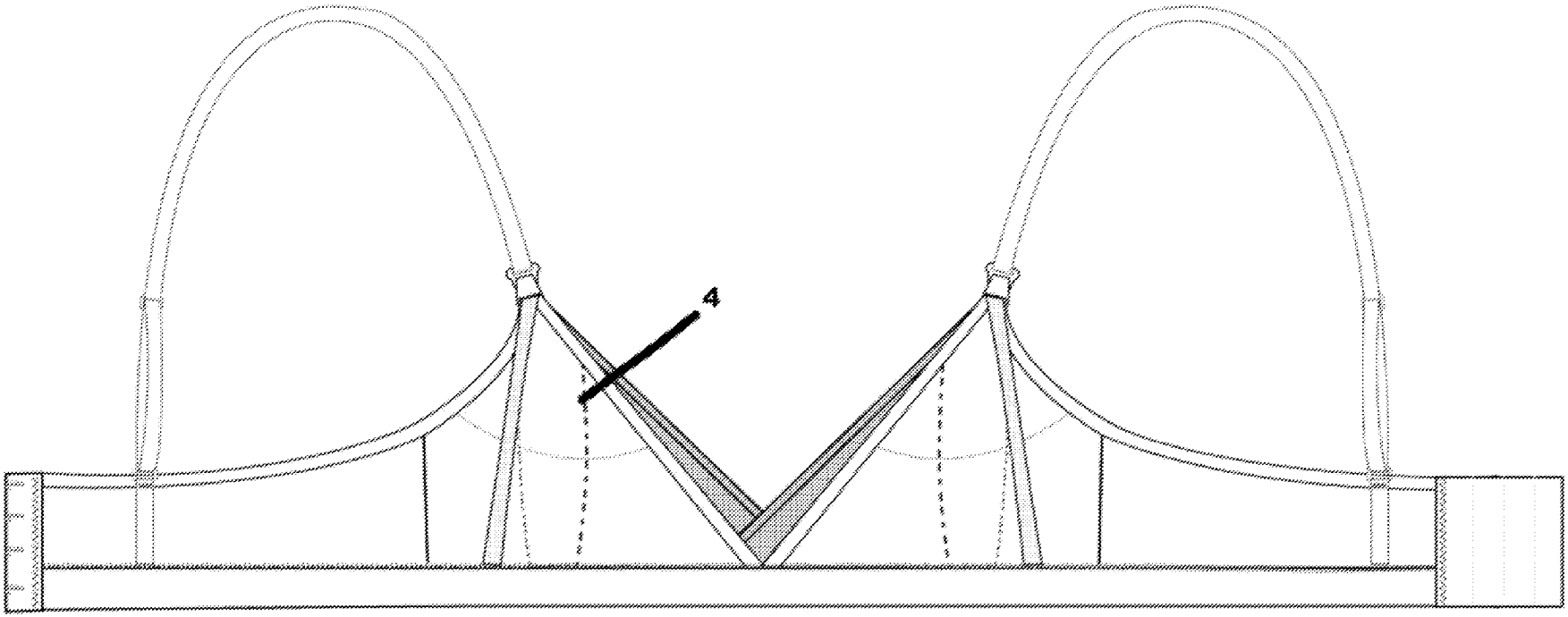
FIG. 6 illustrates an interior view of the apparatus.

FIG. 6 shows an embodiment of an inside view of an apparatus of the present invention in an open configuration depicting the multiple pumping panels 4 with overlapping layers of fabric having a bottom layer, a top layer, and a center layer.

The apparatus of the present invention is a wearable apparatus which may be a clothing undergarment such as a bra (or brassiere). In other embodiments, the apparatus of the present invention may be but is not limited to clothing garments such as a tank top, a dress, a camisole, a shirt, or any other garment typically used to cover and/or support an individual's breasts. In addition, the apparatus of the present invention may incorporate reasonable design parameters, features, modifications, advantages, and variations that are readily apparent to those skilled in the art in the field. For example, the apparatus of the present invention may incorporate underwire, boning, molded cups, padded cups, additional stitching, buttons, ribbon, lace, silk and/or any other design feature well known and readily available and generally available in the field of clothing undergarments such as a bra (or brassiere).

Without departing from the scope and spirit of the present invention, reasonable features, modifications, advantages, and design variations of the claimed apparatus will become readily apparent to those skilled in the art by following the guidelines set forth in the preceding detailed description and embodiments.

What is claimed is:

1. An apparatus to be worn by a lactating individual for breastfeeding and/or hands-free pumping and for accommodating breast size fluctuation in each breast; the apparatus comprising:

a pair of bra panels comprising multiple underlying pumping panels, wherein each bra panel is attached via a detachable connection to an elastic shoulder strap of the apparatus; whereby detaching the bra panel at the detachable connection thereby exposes a breast for breastfeeding; and a pair of outermost crossover cover panels, wherein each crossover cover panel is attached via a panel connector to a bottom elastic band of the apparatus; whereby disconnecting the crossover cover panel at the panel connector exposes the multiple underlying pumping panels for hands-free pumping, wherein the panel connectors are on the bottom elastic band, and wherein each panel connector adjusts each crossover cover panel over each breast of the individual thereby providing a functional reminder to alternate breasts when breastfeeding and/or pumping depending upon which side a crossover cover panel is situated outermost or innermost to the other crossover cover panel.

2. The apparatus of claim 1, wherein the multiple underlying pumping panels comprise overlapping layers of fabric; whereby pulling apart the overlapping layers of fabric creates an opening over a breast nipple to accommodate a breast pump flange.

3. The apparatus of claim 2, wherein the overlapping layers of fabric are stretchable or elastic.

4. The apparatus of claim 2, wherein the overlapping layers of fabric are at least two overlapping layers of fabric.

5. The apparatus of claim 4, wherein the overlapping layers of fabric are three overlapping layers of fabric.

6. The apparatus of claim 4, wherein the overlapping layers of fabric are two overlapping layers of fabric and a bottom layer of fabric which is a breast sling.

7. The apparatus of claim 1, wherein the detachable connection is a clip or a snap having a male portion and a female portion.

8. The apparatus of claim 1, wherein the panel connector comprises more than one connector slot for adjustable closure.

9. The apparatus of claim 1, wherein the panel connector comprises at least one hook.

10. The apparatus of claim 9, wherein the at least one hook is a swan hook.

11. The apparatus of claim 1, wherein the apparatus is a garment selected from the group consisting of a bra, camisole, tank top, dress, and shirt.

12. An apparatus to be worn by a lactating individual for breastfeeding and/or hands-free pumping and for accommodating breast size fluctuation in each breast; the apparatus comprising:

a pair of outermost crossover cover panels, wherein each outermost crossover cover panel is attached via a panel connector to a bottom elastic band of the apparatus; whereby disconnecting the crossover cover panel at the panel connector exposes a nursing panel or pumping panels, wherein the panel connectors are on the bottom elastic band, and wherein each panel connector adjusts each crossover cover panel over each breast of the individual thereby providing a functional reminder to alternate breasts when breastfeeding and/or pumping depending upon which side a crossover cover panel is situated outermost or innermost to the other crossover cover panel.

13. The apparatus of claim 12, wherein the nursing panel is a fabric layer comprising an opening suitable for breastfeeding mode.

14. The apparatus of claim 12, wherein the nursing panel or pumping panels are stretchable or elastic.

15. The apparatus of claim 12, wherein the apparatus is a garment selected from the group consisting of a bra, camisole, tank top, dress, and shirt.

16. The apparatus of claim 12, wherein the pumping panels comprise overlapping layers of fabric; whereby pulling apart the overlapping layers of fabric creates an opening over a breast nipple to accommodate a breast pump flange.

17. An apparatus to be worn by an individual for accommodating breast size fluctuation in each breast; the apparatus comprising: a pair of crossover cover panels, wherein each crossover cover panel is attachable via a panel connector to an elastic horizontal support band of the apparatus below an opposite crossover cover panel of the apparatus, wherein the panel connectors are on the elastic horizontal support band, and wherein each panel connector adjusts each crossover cover panel over each breast of the individual thereby providing a functional reminder to alternate breasts when breastfeeding and/or pumping depending upon which side a crossover cover panel is situated outermost or innermost to the other crossover cover panel.

18. The apparatus of claim 17, wherein the apparatus is a garment selected from the group consisting of a bra, camisole, tank, top, dress, and shirt.

19. The apparatus of claim 17, wherein the panel connector comprises at least one hook and more than one corresponding connector slot for adjustable closure.

* * * * *